US007419023B2

(12) United States Patent
Mieger

(10) Patent No.: US 7,419,023 B2
(45) Date of Patent: Sep. 2, 2008

(54) TRANSFER APPARATUS

(75) Inventor: Rolf Mieger, Kirchdorf-Unteropfingen (DE)

(73) Assignee: Liebherr-Hydraulikbagger GmbH (DE)

( * ) Notice: Subject to any disclaimer, the term of this patent is extended or adjusted under 35 U.S.C. 154(b) by 287 days.

(21) Appl. No.: 11/191,284

(22) Filed: Jul. 28, 2005

(65) Prior Publication Data

US 2006/0103156 A1 May 18, 2006

(30) Foreign Application Priority Data

Jul. 30, 2004 (DE) ..... 20 2004 011 990

(51) Int. Cl.
*B62D 33/00* (2006.01)

(52) U.S. Cl. ..... 180/89.13

(58) Field of Classification Search ..... 180/89.13, 180/89.12; 239/172; 169/24; 296/190.01, 296/190.04, 190.05

See application file for complete search history.

(56) References Cited

U.S. PATENT DOCUMENTS

| | | | | |
|---|---|---|---|---|
| 3,891,264 | A | 6/1975 | Hunter, II et al. | |
| 4,280,589 | A | 7/1981 | Merrick | |
| 4,511,015 | A | 4/1985 | Purdy et al. | |
| 5,746,396 | A * | 5/1998 | Thorton-Trump | 244/134 R |
| 6,983,763 | B2 * | 1/2006 | Benckert et al. | 137/615 |
| 2007/0068889 | A1 * | 3/2007 | Willim | 212/299 |

FOREIGN PATENT DOCUMENTS

| | | | |
|---|---|---|---|
| DE | 2631578 | A1 | 1/1978 |
| DE | 3148960 | A1 | 7/1983 |
| DE | 4225948 | A1 | 12/1993 |
| DE | 4443170 | A1 | 6/1996 |
| EP | 0 308 595 | | 3/1989 |
| EP | 0 960 982 | B1 | 12/1999 |
| EP | 1 153 880 | A | 11/2001 |
| JP | 58065826 | A | 4/1983 |
| JP | 09 032036 | A | 6/1997 |
| JP | 2000 319936 | A | 11/2000 |
| NL | 1 015 068 | C2 | 11/2001 |
| SE | 407 548 | B | 4/1979 |
| SU | 844 556 | A1 | 7/1981 |

* cited by examiner

*Primary Examiner*—Faye M. Fleming
(74) *Attorney, Agent, or Firm*—Carter, DeLuca, Farrell & Schmidt LLP

(57) ABSTRACT

The invention relates to a transfer apparatus comprising an operator cabin articulated at a movable and travelable boom, wherein the boom consists of two partial booms which are connected to one another via a connection piece. In accordance with the invention, at least one partial boom is a telescopic boom.

10 Claims, 6 Drawing Sheets

TRANSFER APPARATUS

Figure 1:
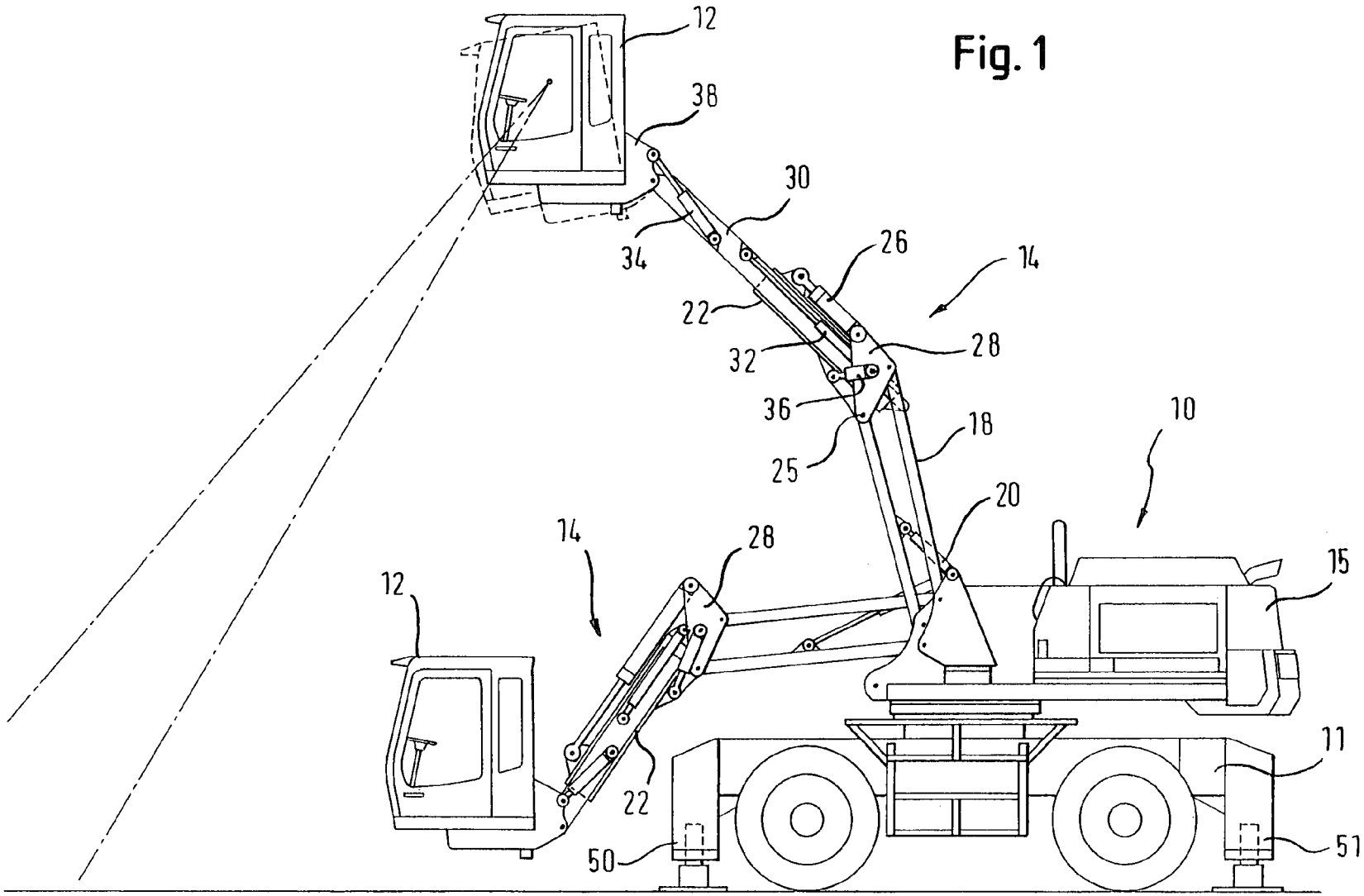

The invention relates to a transfer apparatus in accordance with the preamble of claim 1.

Transfer apparatus are to be understood in this connection as transfer apparatus, for example, for wood, junk or any other goods, but also as excavators and cranes. It is already known with transfer apparatus of this kind to provide an operator cabin as vertically adjustable to permit an improved view over the working area, for example cargo hatches, railroad cars or similar. The cab is arranged on a movable boom for this purpose.

For instance, a mobile loading machine is known from DE 42 25 948 A1, for example, whose cabin can be raised from a starting position close to the machine base by means of parallel connecting rods supported at its base. In this adjustment apparatus, the connecting rod pair engaging at the cabin base in the starting position extends rearwardly up to a raised fixed connection at the revolving superstructure and can be raised together with the cabin along an arc of a circle with the help of a driving cylinder.

A cabin adjustment apparatus of a machine is known from DE 26 31 578 C3 in which a parallel connecting rod transmission is provided for the vertical adjustment of a cabin articulated at the cabin base on the one side and articulated at a column arranged behind the cabin on the other side. The rotatable column is arranged very closely behind the front cabin position so that the cabin remains at least partly above the vehicle in its position facing the rear which can be reached by rotating the column about its vertical axis.

In addition to such a vertical adjustment of the cabin remaining above the machine base, there is frequently the need to move the cabin further forward in the direction of the boom.

To achieve this, in accordance with DE 44 43 170 C2, the boom is made of two lifting frames which are coupled to one another and which have a support piece at their front end to accommodate a cab. The lifting frames consist, in accordance with this specification, of two parallel connecting rod transmissions which are arranged pivotably to one another centrally over a metal connection plate. The pivoting takes place by corresponding piston-in-cylinder arrangements at the parallel connecting rod transmissions.

It is also already known from EP 0 960 982 B1 to pivot the operator cabin of a transfer apparatus or of a machine via two parallel connecting rod transmissions which are pivotable with respect to one another and which can be driven via piston-in-cylinder arrangements.

It is the object of the present invention to further develop a transfer apparatus of the generic type such that the radius and lift height of the movably supported operator cabin is improved even further to achieve an improvement in view. At the same time, the transport height of the retracted operator cabin and of the boom traveling it should be minimized as much as possible despite this improved range of the movable operator cabin.

The object is solved in accordance with the invention by the combination of the features of claim 1. Accordingly, the transfer apparatus is solved by an operator cabin which is articulated on a movable and travelable boom and in which the boom consists of two partial booms which are connected to one another via a connection piece, with the at least one partial boom being a telescopic boom. In accordance with the solution of the invention, the parallel connecting rod transmissions known from the prior art have been at least partly replaced by telescopic booms which hold the cabin in a preselected position by corresponding piston-in-cylinder arrangements. The use of telescopic booms has the advantage that large box cross-sections have a positive effect on the torsion behavior of the boom. The particular advantage of the use of a telescopic boom as at least one of the two partial booms consists of a greater depth of reach being achieved with a maximum radius of the operator cabin, which, for example, permits a descending from the operator cabin close to the ground with a high-set revolving superstructure of a transfer apparatus, whereas the space requirements in travel operation can be minimized.

Further details and advantages of the invention result from the dependent claims following on from the main claim.

Accordingly, the telescopic boom can be pivotably articulated about its pivot point with respect to the first partial boom.

The telescopic boom can be drivable via at least one piston-in-cylinder arrangement.

The telescopic section of the telescopic boom can likewise be travelable by means of a piston-in-cylinder arrangement.

The telescopic boom can be directly connected to the operator cabin. The operator cabin can be pivotable about a pivot point at the telescopic beam by means of a piston-in-cylinder arrangement.

It is particularly advantageous for a further piston-in-cylinder arrangement to be provided in addition to the piston-in-cylinder arrangement, said further piston-in-cylinder arrangement being articulated between the two partial booms at the telescopic boom, on the one hand, and at the connection piece, on the other hand, with the piston-in-cylinder arrangements being coupled to one another such that the displaced oil volume from the piston-in-cylinder arrangement articulated at the connection piece being transported into the piston-in-cylinder arrangement articulated at the operator cabin in order to produce the same lift length there so that the same angular change results, and thus the operator cabin remains in its position, with the telescopic boom and the operator cabin with a corresponding pivoting.

In accordance with a further advantageous aspect of the invention, the first partial boom is in particular a parallel connecting rod transmission movable via a piston-in-cylinder arrangement. Within the framework of the invention, however, the second partial boom can also be made as a parallel connecting rod transmission instead of the first one.

In accordance with the invention, however, at least the second partial boom, or optionally the first partial boom, is made as a telescopic boom. Within the framework of the invention, both partial booms can also be made as telescopic booms, with the corresponding movability of the telescopic booms then being achieved by corresponding piston-in-cylinder arrangements.

It is also within the framework of the invention that the telescopic boom is replaced by a simple mono boom.

Figure 2:
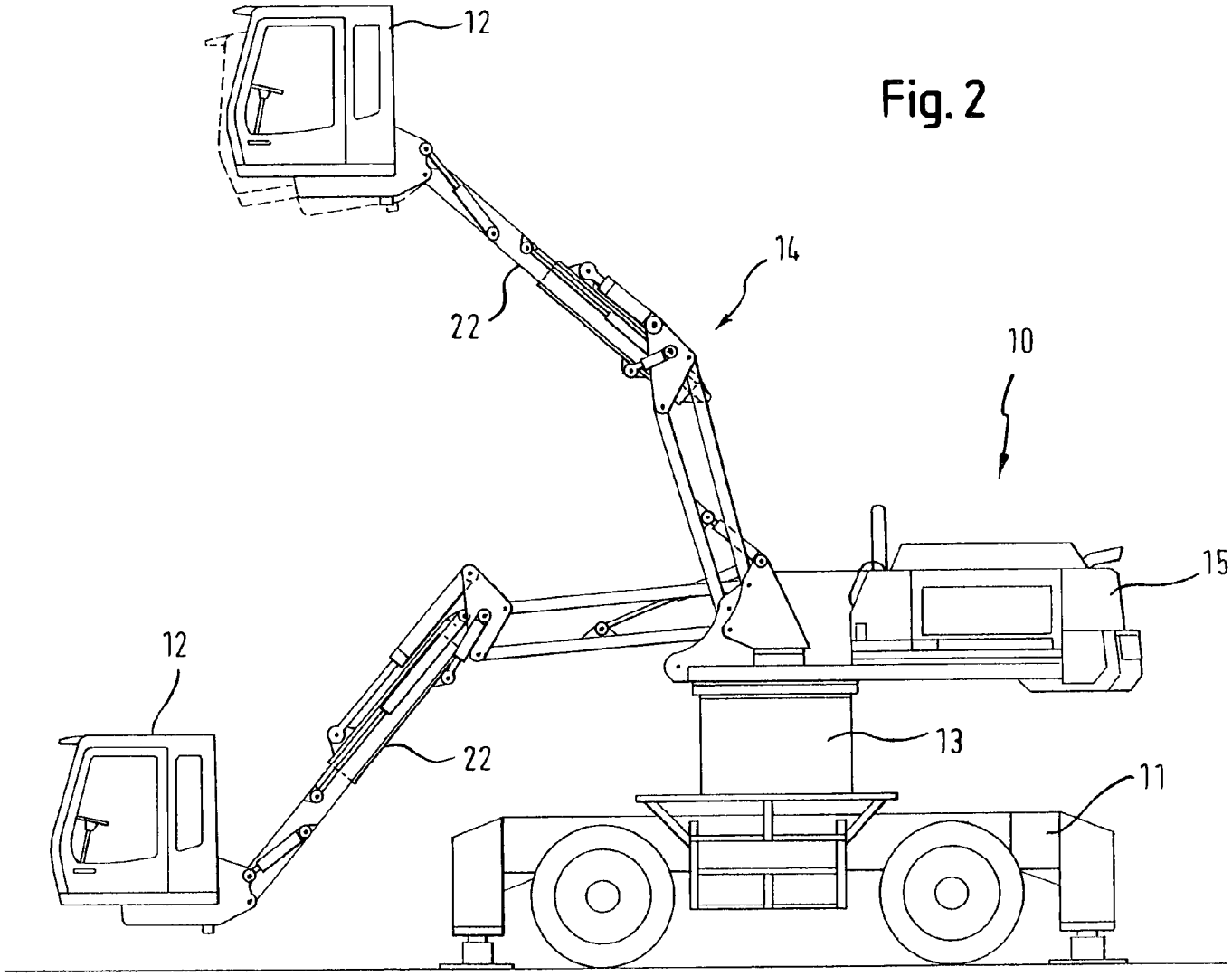
Figure 3:
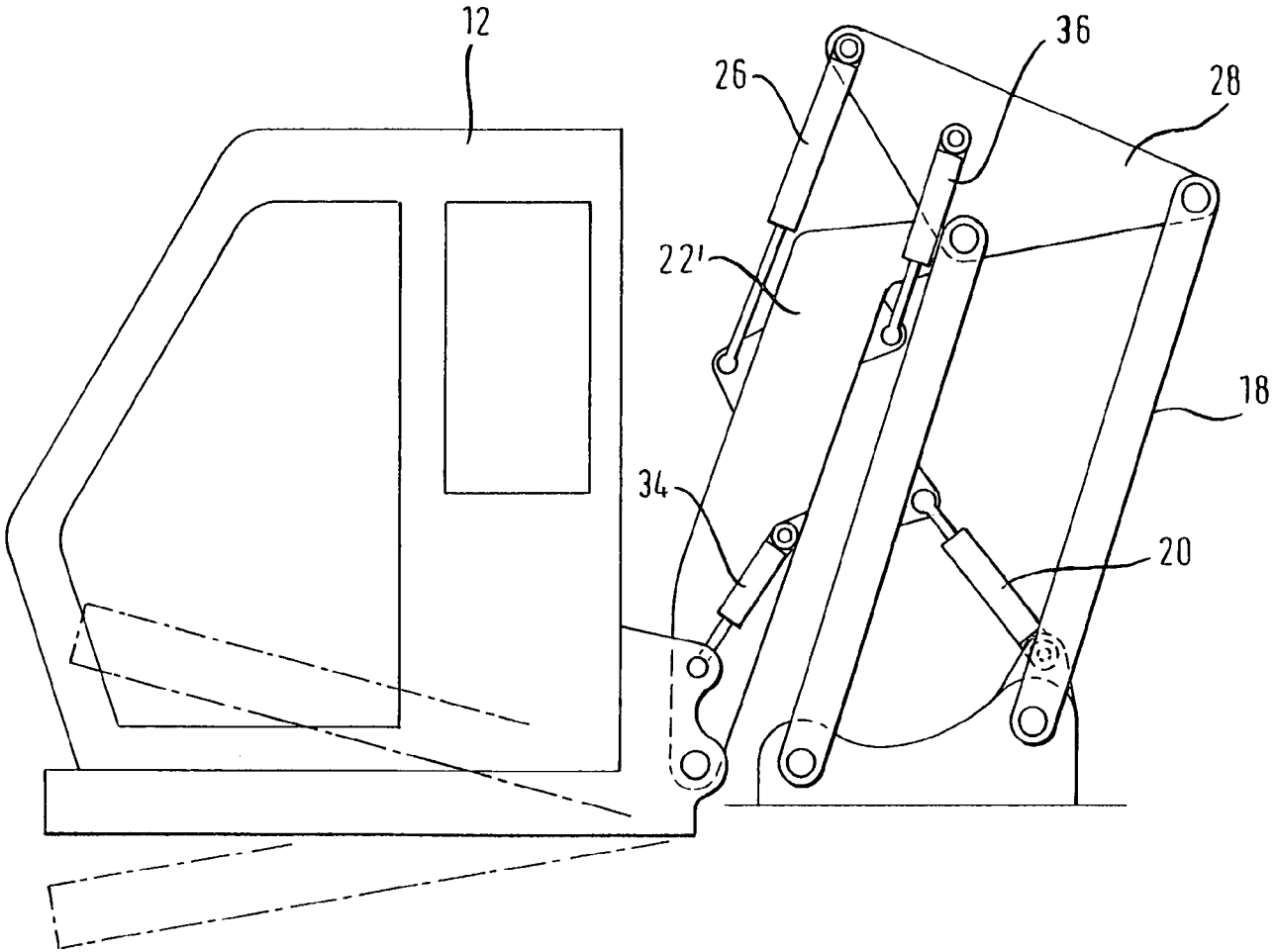
Figure 4:
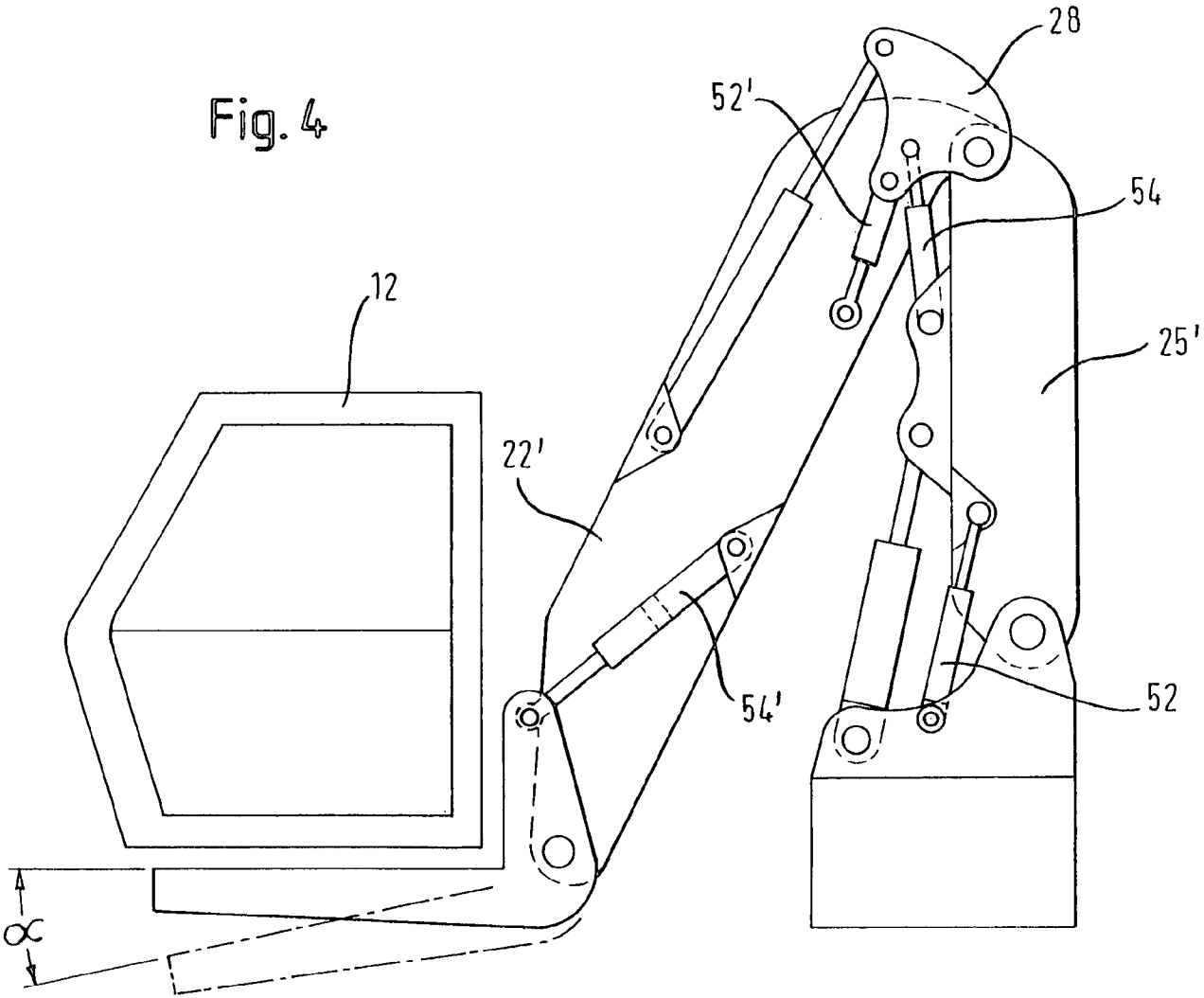
Figure 5:
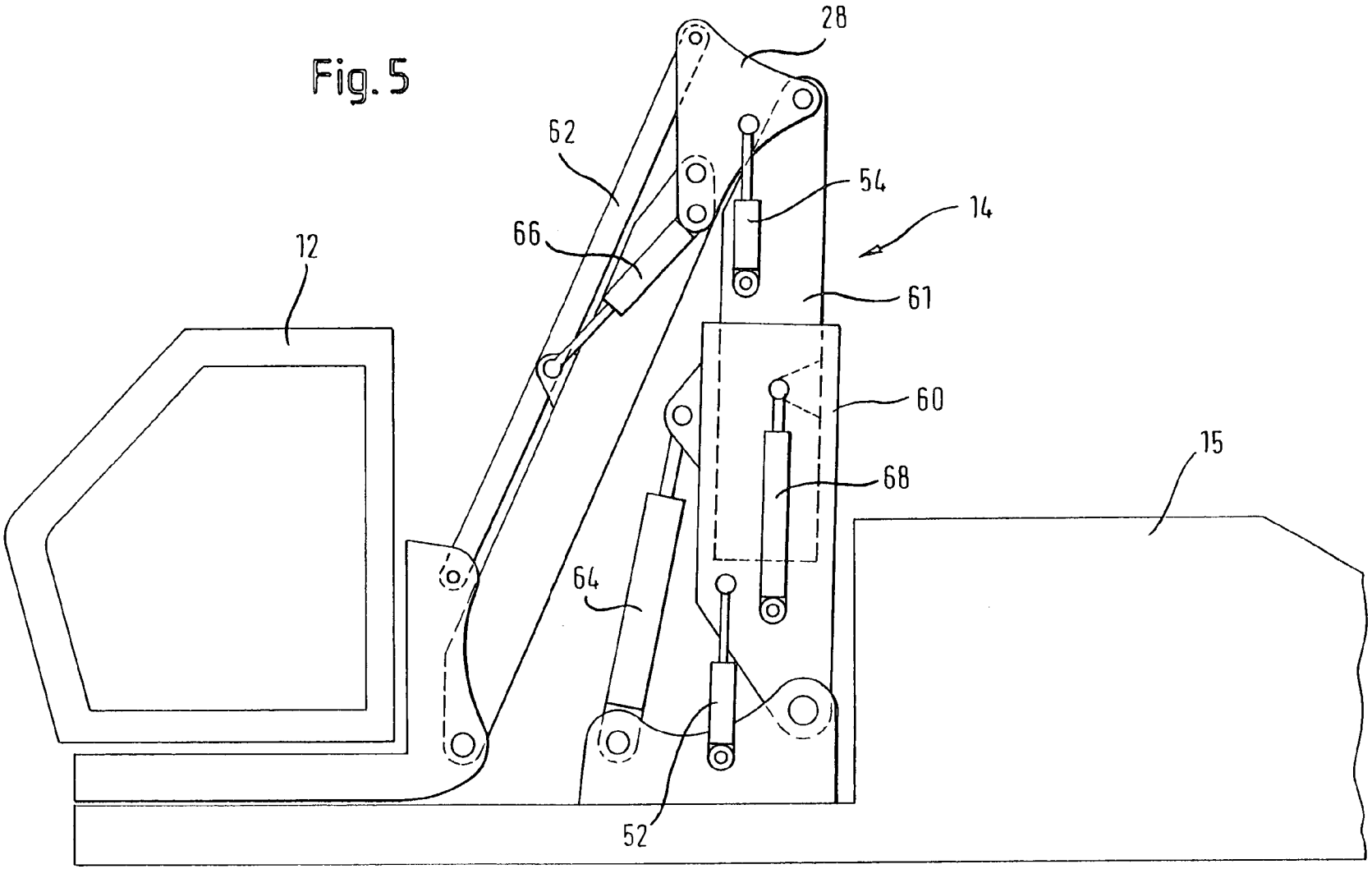
Figure 6:
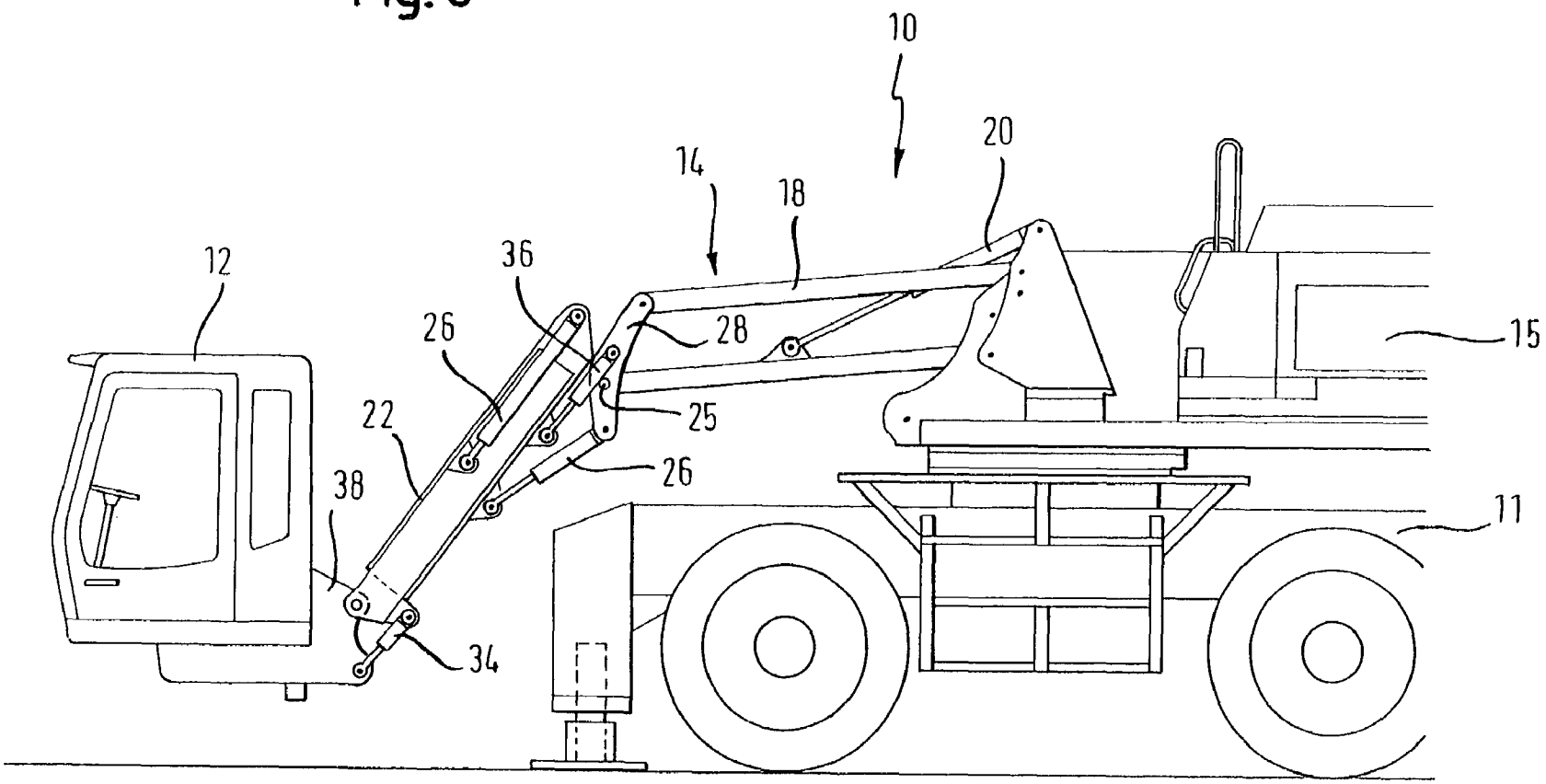

Further details and advantages of the invention will be explained in more detail with reference to embodiments shown in the drawing. There are shown:

FIG. 1: a transfer apparatus with an operator cabin adjustment apparatus in accordance with the present invention;

FIG. 2: a modified transfer apparatus with the operator cabin adjustment apparatus of the invention such as was already shown in FIG. 1;

FIG. 3: a detailed representation of the operator cabin adjustment apparatus in accordance with a further aspect of the invention;

FIG. 4: a further cabin adjustment apparatus in accordance with the invention in a modified embodiment;

FIG. 5: another embodiment variant of the operator cabin adjustment apparatus in accordance with the invention; and FIG. 6: again a transfer apparatus of the present invention with a modified operator cabin adjustment apparatus in accordance with the present invention.

FIG. 1 shows a transfer apparatus 10 in a first embodiment in accordance with the present invention, with the structure of the mounting unit 11 and of the revolving superstructure 15 of the transfer apparatus being conventional and therefore not requiring any further explanation. The mounting unit 11 is, as shown here, supported by supports 50 and 52. The present invention relates to the adjustment apparatus for the travelable operator cabin 12. It consists of a boom 14 which is shown in two different positions by the representation in accordance with FIG. 1. On the one hand, the operator cabin is moved via the boom into an elevated position in which the operator has a good overview, with the viewing angle being drawn in FIG. 1.

In the embodiment shown in FIG. 1, the boom 14 consists of a first partial boom which is made as a parallel connecting rod transmission 18. The one end of the parallel connecting rod transmission 18 is articulated at the revolving superstructure 15, whereas the other end is articulated at a connection piece 28. The parallel connecting rod transmission 18 is pivoted by a piston-in-cylinder arrangement 20. The second partial boom in the form of a telescopic boom 22 is arranged at the connection piece 28, with the telescopic boom being pivotable about the pivot point 25 with respect to the parallel connection rod transmission 18. The free end of the telescopic boom, more precisely the travelable telescopic section 30 of the telescopic boom 22, is connected to a support piece 38 which supports the operator cabin 12.

A piston-in-cylinder arrangement 32 is provided to travel the telescopic section. The telescopic boom can be pivoted about its pivot point 25 via the piston-in-cylinder arrangement 26 since the piston-in-cylinder arrangement 26 engages at the telescopic boom 22, on the one hand, and at the connection piece 28, on the other hand. The support piece 38 and the cabin 12 connected thereto can be pivoted in relation to the telescopic boom 22 via a piston-in-cylinder arrangement 34. The cabin is shown in two pivot positions in the raised position in FIG. 1.

For the control of the operator cabin 12, another piston-in-cylinder arrangement 36, which is articulated at the connection piece 28, on the one hand, and at the lower part of the telescopic boom 22, on the other hand, in the manner shown in FIG. 1, is provided in addition to the piston-in-cylinder arrangement 34. The piston-in-cylinder arrangements 34 and 36 are made as so-called master cylinders and the support piece 38 at which the operator cabin 12 is arranged is controllable via these two master cylinders 34 and 36 such that the operator cabin 12 also remains in its set horizontal position or inclined position during the traveling of the telescopic boom. The piston-in-cylinder arrangements 34 and 36 are arranged at the telescopic boom and are coupled to one another such that, for example, the oil volume displaced from the piston-in-cylinder arrangement 36 moves into the piston-in-cylinder arrangement 34 and there causes the same lift change as in the piston-in-cylinder arrangement 36 (master cylinder).

In FIG. 2, a material transfer apparatus 10 is shown with an operator cabin 12 which is connected to the revolving superstructure 15 via a boom 14, with this arrangement being identical to that in accordance with FIG. 1. In the embodiment shown here, however, the revolving superstructure 15 of the transfer apparatus 10 is set high with respect to the mounting unit 11 by insertion of an intermediate piece 13. As can be seen from the different representations of the travelable operator cabin 12 in this FIG. 2, a descending from the operator cabin 12 close to the ground is possible despite this high-set arrangement of the revolving superstructure 15 since the telescopic boom 22 ensures a greater depth of range of the operator cabin. In the representation of FIG. 2, the telescopic boom is moved downwardly toward the ground by the vertical difference of the intermediate piece 13 in comparison with the representation in accordance with FIG. 1.

In FIG. 3, a modified embodiment is shown which is likewise within the framework of the invention. A mono boom 22' is provided here instead of a telescopic boom 22.

In the embodiment variant in accordance with FIG. 4, an embodiment is shown in which the two partial booms are mono booms 22' and 25', Here, the booms are equipped with control cylinders 52 and 54 which permit a compensation, in place of the parallel connecting rod transmission 18, such that the cabin 12 can be held in the desired horizontal or slightly inclined position. The possible inclination of the operator cabin 12 is given by the angle $\alpha$ in FIG. 4.

The modified representation in accordance with FIG. 5 shows an embodiment variant of the boom 14 in which the first partial boom connected to the revolving superstructure 15 is made as a telescopic boom 60, whereas the second partial boom is made as a parallel connecting rod transmission 62. Here, lift cylinders 64 and 66 are provided which serve the lifting of the cabin 12. A piston-in-cylinder arrangement is designated by 68 which serves the traveling of a telescopic section 61 from the telescopic boom 60. In turn, the control cylinders are designated by 52, 52' and 54, 51' which serve, as also in the embodiment variant in accordance with FIG. 4, to hold the operator cabin in the horizontal position.

Finally, an embodiment of a transfer apparatus 10 is shown in FIG. 6 which is similar to that of FIG. 1. Here, however, the piston-in-cylinder arrangement 26 and the piston-in-cylinder arrangement 34 are arranged below the telescopic boom 22. In this respect, the articulation point of the telescopic boom 22 at the support piece 38 of the operator cabin 12 is arranged above the articulation point of the piston-in-cylinder arrangement 34 at the support piece 38.

The invention claimed is:

1. A transfer apparatus comprising a support base and an operator cabin articulated at a movable and travelable boom, wherein the boom consists of at least first and second partial booms which are connected to one another via a connection piece, wherein the first partial boom is a telescopic boom having a distal end portion and a proximal end portion, the telescopic boom having a telescopic section adapted to project from the distal end portion of the telescopic boom, the telescopic section connected to the operator cabin, the operator cabin being articulated pivotably at the telescopic boom about a pivot point by a first piston-in-cylinder arrangement between the telescopic section and the operator cabin, the proximal end portion of the telescopic boom being articulated pivotably about a pivot point with respect to the second partial boom by a second piston-in-cylinder arrangement at the connection piece, wherein the first and second piston-in-cylinder arrangements interact with one another such that a displaced oil volume from the first piston-in-cylinder arrangement is transported into the second piston-in-cylinder arrangement to produce a same lift length there such that the same angular change results with the telescopic boom and the operator cabin, wherein the second partial boom includes a parallel connecting rod transmission movable via a third piston-in-cylinder arrangement.

2. A transfer apparatus in accordance with claim 1, wherein the telescopic boom is drivable via at least one piston-in-cylinder arrangement.

3. A transfer apparatus in accordance with claim 1, wherein the telescopic section of the telescopic boom is travelable by means of a piston-in-cylinder arrangement.

4. A transfer apparatus in accordance with claim 1, wherein the second partial boom is articulated pivotably about a pivot point with respect to the support base by the third piston-in-cylinder.

5. A transfer apparatus in accordance with claim 1, wherein the first and second partial booms are telescopic booms.

6. A transfer apparatus in accordance with claim 1, wherein a support piece is interposed between the operator cabin and the telescopic section.

7. A transfer apparatus comprising a support base and an operator cabin articulated at a movable and travelable boom, wherein the boom includes at least first and second partial booms which are connected to one another via a connection piece, wherein the first partial boom has a distal end portion and a proximal end portion, the proximal end portion of the first partial boom connected to the operator cabin, the operator cabin being articulated pivotably at the first partial boom about a pivot point by a first piston-in-cylinder arrangement between the first partial boom and the operator cabin, the proximal end portion of the first partial boom being articulated pivotably about a pivot point with respect to the second partial boom by a second piston-in-cylinder arrangement at the connection piece, wherein the first and second piston-in-cylinder arrangements interact with one another such that a displaced oil volume from the first piston-in-cylinder arrangement is transported into the second piston-in-cylinder arrangement to produce a same lift length there such that the same angular change results with the first partial boom and the operator cabin, wherein the second partial boom is operably connected to the support base and is pivotally movable via a third piston-in-cylinder arrangement.

8. A transfer apparatus according to claim 7, wherein either or both the first partial boom and second partial boom is a telescoping boom.

9. A transfer apparatus according to claim 7, wherein a support piece is interposed between the operator cabin and the distal end portion of the first partial boom.

10. A transfer apparatus according to claim 7, wherein the second partial boom includes a parallel connecting rod transmission movable via a third piston-in-cylinder arrangement.

* * * * *